US006983497B2

(12) United States Patent
Lobry et al.

(10) Patent No.: US 6,983,497 B2
(45) Date of Patent: Jan. 10, 2006

(54) TENSION-VARYING SLIDER FOR A SET OF THREE SLATS

(75) Inventors: Jacques Lobry, Bourges (FR); Jean-Jacques Bonnefoy, Bourges (FR); Christophe Tat, Bourges (FR)

(73) Assignee: Tournadre S.A. Standard Gum, Bourges (FR)

( * ) Notice: Subject to any disclaimer, the term of this patent is extended or adjusted under 35 U.S.C. 154(b) by 2 days.

(21) Appl. No.: 10/722,150

(22) Filed: Nov. 25, 2003

(65) Prior Publication Data

US 2004/0128759 A1 Jul. 8, 2004

(30) Foreign Application Priority Data

Dec. 2, 2002 (FR) ..... 02 15117

(51) Int. Cl.
*A47C 23/06* (2006.01)

(52) U.S. Cl. ..... 5/236.1; 5/239

(58) Field of Classification Search ..... 5/236.1, 5/237–239, 241, 242, 243, 244, 245, 935
See application file for complete search history.

(56) References Cited

U.S. PATENT DOCUMENTS 6,219,863 B1 * 4/2001 Loberg et al. ..... 5/236.1

FOREIGN PATENT DOCUMENTS

| | | | | |
|---|---|---|---|---|
| DE | 197 18 577 A1 | | 11/1998 | |
| DE | 298 10 728 U1 | | 7/1999 | |
| DE | 101 14 451 A1 | | 10/2002 | |
| FR | 2666973 | | 3/1992 | |
| FR | 0215117 | | 7/2003 | |
| FR | FA628259 | | 7/2003 | |
| IT | 436738 | * | 6/1948 | ..... 5/242 |

* cited by examiner

*Primary Examiner*—Michael Safavi
(74) *Attorney, Agent, or Firm*—Lucas & Mercanti, LL

(57) ABSTRACT

The invention provides a single piece tension-varying slider for a set of three slats of a bed base, which set comprises two parallel slats in the plane on which the mattress rests and a lower slat disposed substantially in the vertical midplane between the two upper slats, said slats being supported at their ends by fixing means for fixing to the longitudinally-extending members of the frame of the bed base, said slider comprising a suspension device for bearing against the lower slat, and fixing means for fixing said device to the upper slats, wherein the fixing means comprise a strip for being placed across and over the upper slats, said strip having a respective bend at each of its ends for co-operating with a respective outer edge of said two upper slats, one of the bends being connected to the suspension device by a junction wall.

13 Claims, 2 Drawing Sheets

FIG.1
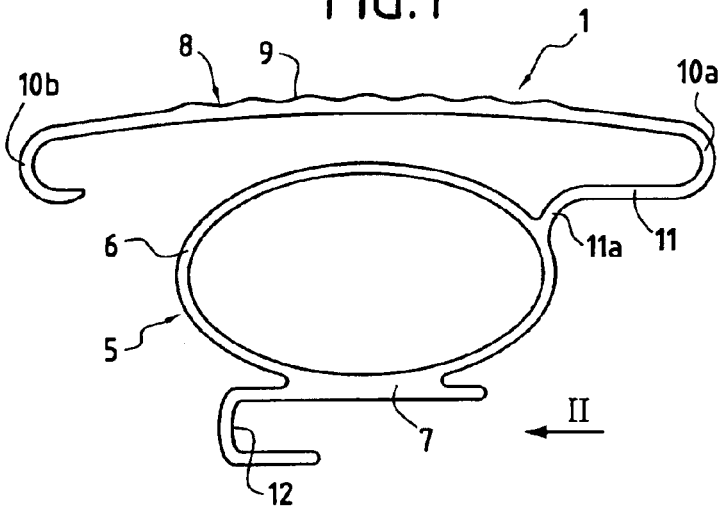
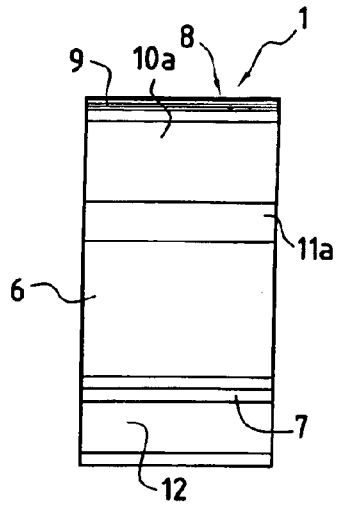
FIG.2
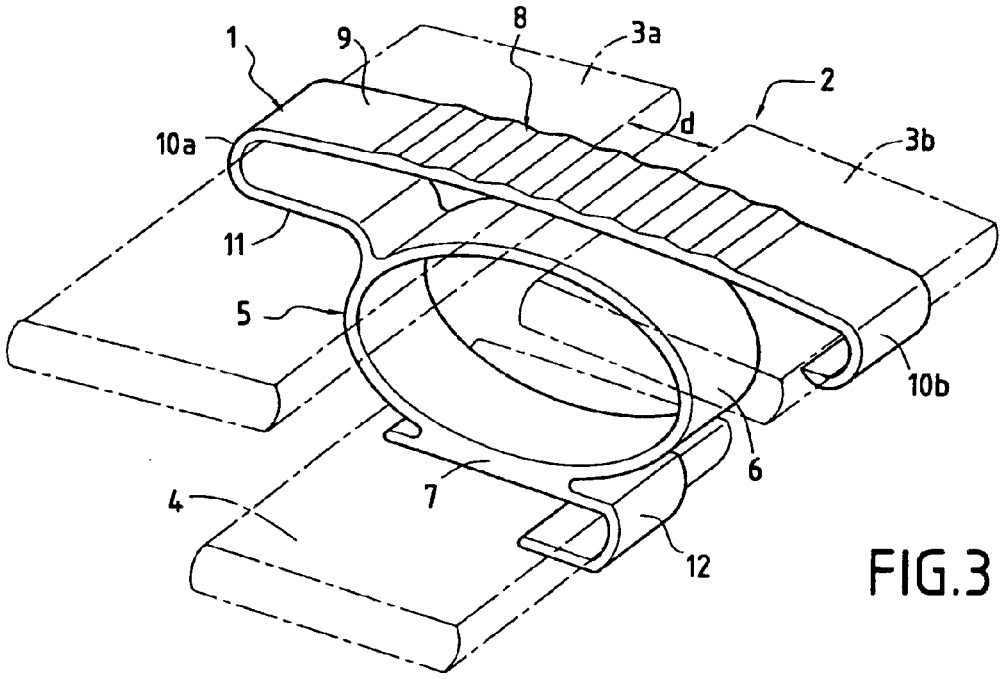
FIG.3

TENSION-VARYING SLIDER FOR A SET OF THREE SLATS

The present invention relates to the field of beds.

More particularly, it relates to a tension-varying slider for fitting to a set of three slats of slatted bed bases in order to enable the flexibility of the slats to be adjusted at will.

BACKGROUND OF THE INVENTION

The slats of bed bases are generally fixed to the longitudinally-extending members of the frame of the base via endpieces which have housings for engaging their ends. These endpieces and the slats constitute the suspension means of the bed base and the stiffness thereof is selected on purchasing the bed base.

Nevertheless, depending on the weight and the morphology of the person using the bed, it may be useful to be able to modify the stiffness of each set of three slats.

This can be achieved in particular by adding tension-varying sliders. In general, tension-varying sliders include at least one through orifice through which a slat is threaded while the bed base is being assembled. The slider can be moved along the slat, thus enabling stiffness to be modified between the left-hand portion and the right-hand portion of the bed base. However, in order to remove the slider and place it on some other, more appropriate slat, it is necessary to take the base apart, which is an operation that is lengthy and difficult to perform by un-practiced users.

A tension-varying slider for a set of three slats of a bed base is also known, in particular from FR 2 666 973, which is constituted by two parallel upper slats placed in the plane on which the mattress rests, and a lower slat disposed substantially in the midplane between the two upper slats, the ends of slats being held via fixing means to the long sides of the frame of the bed base, which slider can easily be moved from one set of upper slats to another set without damaging the bed base. This is achieved by the fact that the means for fixing the slider to the upper slats include a structure for engaging the upper slats, which structure is constituted by a central core surmounting a suspension device and from which there extend two laterally-open housings for receiving the upper slats. The width of the slider is less than the spacing between two upper slats, thus making it possible during assembly to place the housings between two of said slats, and then to turn the slider through one-fourth of a turn about a vertical axis in order to fix it to the two upper slats at the desired location and on the desired set of three slats. Disassembly is performed in the reverse order, by turning the slider through one-fourth of a turn.

The width of the slider is thus limited by the spacing between two upper slats, so as to enable it to be assembled and disassembled. The width of the suspension means of the tension-varying slider that are designed to bear against the bottom slat is likewise limited by the spacing of two upper slats so as to enable it to be passed between said two slats for assembly or disassembly purposes.

Unfortunately, it can be useful for the width of the suspension means to be unlimited, where said width is measured in the long direction of the slats when the slider is in use.

OBJECTS AND SUMMARY OF THE INVENTION

The invention provides a tension-varying slider for a set of three slats, which slider is easy to install, and is easy to move, and in which the size of the suspension devices in the direction of the slat is not subject to a limitation.

The invention achieves this object by the fact that the means for fixing the suspension device on the upper slat comprise a strip for placing transversely above said upper slat, said strip having at each of its ends a respective bend for co-operating with an outside edge of said two slats, one of the bends being connected to the suspension device via a junction wall.

The bends co-operate with the edges of the slats like hooks. Because of the elasticity of the endpieces of the slats, it is easy, manually, to move the upper two slats of a set of three slats towards each other so as to enable the free bend to hook on, once the suspension device of the slider has been positioned beneath the two upper slats, with one of the slats being received in the bend connected to the junction wall.

According to a particular characteristic, the tension-varying slider further comprises catch means for preventing the suspension device from moving on the lower slat. The catch means advantageously comprise a third bend co-operating with one of the side edges of the lower slat. This third bend is preferably disposed on the side opposite from the junction wall.

According to another advantageous characteristic, the tension-varying slider of the invention also has means for preventing the suspension device for moving under the upper slat. These means are preferably constituted by a tongue secured to the suspension device and extending substantially symmetrically to the junction wall about the vertical midplane between the two upper slats, said tongue being designed to bear against the underside of an upper slat.

In order to position the tension-varying slider properly on the set of three slats, the strip may also have two lugs which extend downwards from its edges, said lugs being designed to be received in the space between the two upper slats.

The strip may also carry a vertical peg projecting from its under face to be received at least in part in a hole formed in the top wall of the suspension device.

The suspension device is in the form of a sleeve. The axial dimension of the sleeve is independent of the spacing between two upper slats, with this dimension being calculated as a function of the desired stiffness.

The tension-varying slider of the invention is made of an elastomer or thermoplastic type material by molding, providing sufficient flexibility to achieve a hinge effect, in particular at the bend connected to the junction wall so as to make installation and removal of the slider easy.

BRIEF DESCRIPTION OF THE DRAWINGS

Other advantages and characteristics of the invention appear on reading the following description given by way of non-limiting example and with reference to the accompanying drawings, in which:

FIG. 1 is a front view of a tension-varying slider constituting a first embodiment of the invention;

FIG. 2 is a side view of the FIG. 1 tension-varying slider;

FIG. 3 is a perspective view of the FIG. 1 tension-varying slider shown in its state when mounted on a set of three slats;

MORE DETAILED DESCRIPTION

Figure 4:
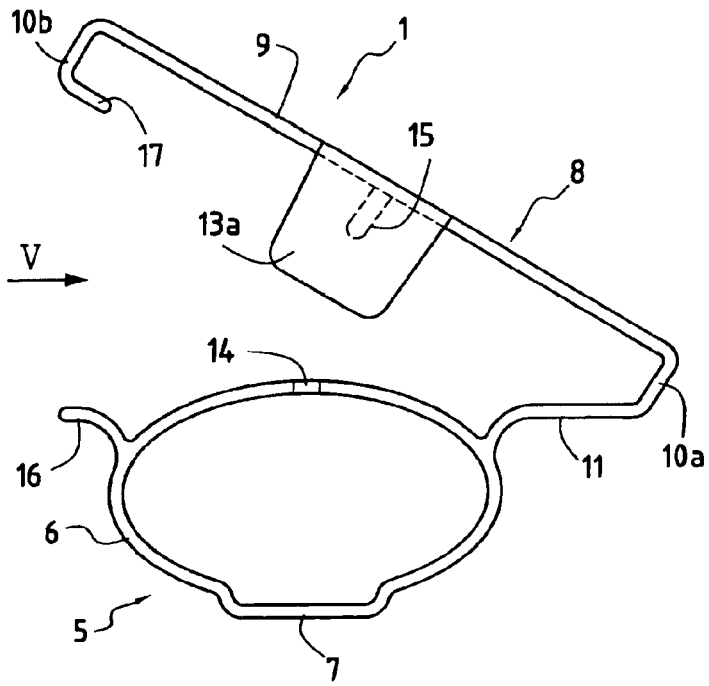
FIG. 4 is a front view of a tension-varying slider constituting a second embodiment of the invention, the upper strip being shown in its position when moved away upwards so as to show the hinge effect of the bend connected to the junction wall.

FIGS. 1 to 3 show a tension-varying slider 1 constituting a first embodiment, designed to be mounted on a set of three bed-base slats 2 comprising two upper slats 3*a*, 3*b* in the plane on which a mattress rests, together with a lower slat 4 lying substantially in the vertical midplane between the two upper slats 3*a* and 3*b*. The two upper slats 3*a* and 3*b* are spaced apart by a gap d.

The tension-varying slider 1 comprises a suspension device 5 in the form of a sleeve 6 of circular or elliptical section, with a base 7 that rests on the top face of the lower slat 4, and fixing means 8 for fixing the suspension device 5 to the upper slats 3*a* and 3*b*.

The fixing means comprise a strip 9 for placing transversely over the top faces of the upper slats 3*a* and 3*b*, with the ends of the strip forming bends or hooks 10*a*, 10*b* for co-operating with the outer side edges of the two upper slats 3*a* and 3*b*.

One of these bends, e.g. 10*a*, co-operates with the outer side edge of the upper slat 3*b*, and is in turn connected to the suspension device 5 by a junction wall 11. This junction wall 11 is substantially horizontal and bears against the underside of the upper slat 3*a*, and is connected to the wall of the sleeve 6 via a curved portion 11*a*.

The base 7 of the suspension device also has a third bend or hook 12 on the same side as the bend 10*b* and for the purpose of co-operating with the adjacent side edge of the lower slat 4.

The tension-varying slider 1 as described above constitutes a single piece, and it is preferably made by molding a material of the elastomer or thermoplastic type which provides sufficient stiffness, together with a degree of flexibility so as to enable said slider to be assembled on a set of three slats.

The ends of the three slats 3*a*, 3*b*, and 4 are engaged in housings in endpieces that are fixed on the longitudinally-extending portions of a bed base.

The dimensions of the tension-varying slider 1 are adapted to the dimensions of the slats 3*a*, 3*b*, and 4, and to their spacing at rest.

In order to install the tension-varying slider 1 on a set of slats, the strip 9 should be lifted with the bend 10*a* then acting as a hinge, the suspension device 6 should then be placed on the lower slat, with the bottom bend 12 being properly positioned against the side wall of the lower slat 4, and then the strip 9 should be lowered onto the upper slats 3*a* and 3*b*, with the slat 3*a* being positioned against the bend 10*b*, and then the two upper slats 3*a* and 3*b* should be moved towards each other so as to allow the bend 10*b* to pass over the outer side edge of the slat 3*a*. The three slats 10*a*, 10*b*, and 12 then hold the tension-varying slider 1 on the set of three slats.

It will be understood that the tension-varying slider is removed by performing the reverse process, thus making it easy to remove the slider in order to replace it at some other location or on a different set of three slats, without requiring the bed base to be disassembled.

The width of the tension-varying slider 1, i.e. its dimension in the long direction of the slat, is independent of the spacing d between two upper slats. In addition, the width of the strip 9 and the width of the sleeve 6 may be different, the width of the sleeve 9, i.e. its extent in the axial direction of the slats, can be selected as a function of the desired stiffness.

Figure 5:
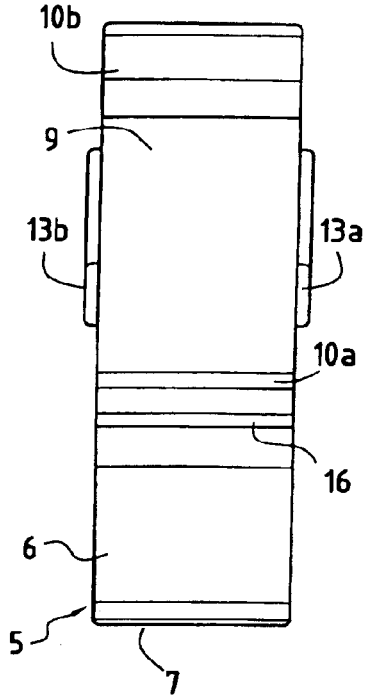
FIG. 5 is a side view of the FIG. 4 tension-varying slider.
Figure 6:
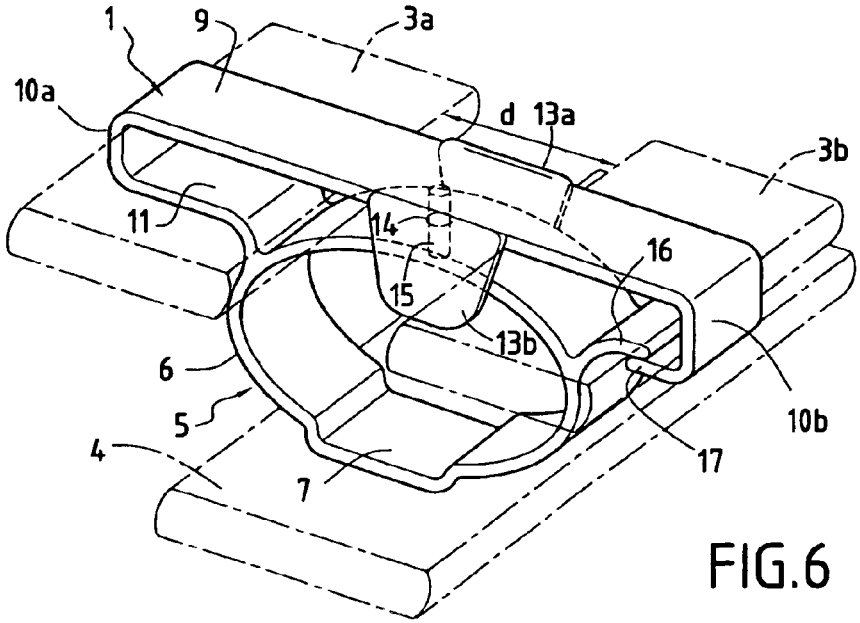
FIG. 6 is a perspective view of the FIG. 4 tension-varying slider, shown mounted on a set of three slats.

FIGS. 3 to 5 show a second embodiment of the invention.

In this second embodiment for a set of three slats comprising two upper slats 3*a* and 3*b* and a lower slat 4, the tension-varying slider 1 likewise comprises a suspension device 5 presenting a sleeve 6 having a base 7 for resting on the lower slat 4, and fixing means 8 comprising a strip 9 terminated at each end by a respective bend or hook 10*a*, 10*b*, one of which, 10*a*, is connected to the sleeve 6 by a junction wall 11.

The strip 9 presents two lugs 13*a* and 13*b* on its side edges, which extend downwards and which are designed to be received in the gap d between the two upper slats 3*a* and 3*b*.

The top wall of the sleeve 6 presents an orifice 14 for receiving at least part of a peg 15 formed to coincide therewith under the bottom face of the strip 9.

The sleeve 6 also presents a tongue 16 projecting from its base remote from the junction wall 11, which tongue 16 extends substantially symmetrically relative to the junction wall 11 so that, once the slider is in place, it bears against the under face of the upper slat 3*b*, in register with the end 17 of the bend 10*a*.

The lugs 13*a*, 13*b*, the peg 15, and the tongue 16 enable the suspension device 5 to be positioned accurately relative to the upper slats 3*a* and 3*b*. That is why the base 7 does not have a third bend 12 in this second embodiment.

It should be observed that the tension-varying slider 1 in the first embodiment as shown in FIGS. 1 to 3 could also be provided with lugs 13*a* and 13*b* and a peg 15 on the strip 9, together with an orifice 14 in the top wall of the sleeve 6.

What is claimed is:

1. A single piece tension-varying slider for a set of three slats in a bed base, the set comprising two parallel slats in the plane on which the mattress rests together with a lower slat disposed substantially in the vertical midplane between the two upper slats, said slats being supported at their ends by securing means engaging the longitudinally-extending members of the frame of the bed base, said slider comprising a suspension device for bearing against the lower slat, and fixing means for fixing said device to the upper slats;

wherein the fixing means comprise a strip for being placed across and over said upper slats, said strip having a respective bend at each of its ends for co-operating with respective outer edges of said two upper slats, only one of the bends being connected to the suspension device by a junction wall.

2. A tension-varying slider according to claim 1, further comprising a third bend co-operating with a side edge of the lower slat for preventing the suspension device from moving on the lower slat.

3. A tension-varying slider according to claim 2, wherein the third bend is disposed on the side remote from the junction wall.

4. A tension-varying slider according to claim 1, further comprising a tongue secured to the suspension device and extending substantially symmetrically to the junction wall about the vertical midplane between the two upper slats, said tongue serving to bear against the underside of an upper slat for preventing the suspension device from moving under the upper slats.

5. A tension-varying slider according to claim 1, wherein the strip further comprises two lugs extending downwards from the sides of the strip, for being received in the gap between the two upper slats.

6. A tension-varying slider according to claim 1, wherein the strip carries a vertical peg on its bottom face for being received at least in part in an orifice formed in the top wall of the suspension device.

7. A tension-varying slider according to claim 1, wherein the suspension device is in the form of a sleeve.

8. A tension-varying slider according to claim 1, the slider being made of an elastomer or thermoplastic type material.

9. A single piece tension-varying slider for a set of three slats in a bed base, the set comprising two parallel slats in the plane on which the mattress rests together with a lower slat disposed substantially in the vertical midplane between the two upper slats, said slats being supported at their ends by securing means engaging the longitudinally-extending members of the frame of the bed base, said slider comprising a suspension device for bearing against the lower slat, and fixing means for fixing said device to the upper slats;

wherein the fixing means comprise a strip for being placed across and over said upper slats, said strip having a respective bend at each of its ends for co-operating with respective outer edges of said two upper slats, one of the bends being connected to the suspension device by a junction wall, and wherein the single piece tension-varying slider further comprises a third bend co-operating with a side edge of the lower slat for preventing the suspension device from moving on the lower slat.

10. A tension-varying slider according to claim 9, wherein the third bend is disposed on the side remote from the junction wall.

11. A single piece tension-varying slider for a set of three slats in a bed base, the set comprising two parallel slats in the plane on which the mattress rests together with a lower slat disposed substantially in the vertical midplane between the two upper slats, said slats being supported at their ends by securing means engaging the longitudinally-extending members of the frame of the bed base, said slider comprising a suspension device for bearing against the lower slat, and fixing means for fixing said device to the upper slats;

wherein the fixing means comprise a strip for being placed across and over said upper slats, said strip having a respective bend at each of its ends for co-operating with respective outer edges of said two upper slats, one of the bends being connected to the suspension device by a junction wall, and wherein the single piece tension-varying slider further comprises a tongue secured to the suspension device and extending substantially symmetrically to the junction wall about the vertical midplane between the two upper slats, said tongue serving to bear against the underside of an upper slat for preventing the suspension device from moving under the upper slats.

12. A single piece tension-varying slider for a set of three slats in a bed base, the set comprising two parallel slats in the plane on which the mattress rests together with a lower slat disposed substantially in the vertical midplane between the two upper slats, said slats being supported at their ends by securing means engaging the longitudinally-extending members of the frame of the bed base, said slider comprising a suspension device for bearing against the lower slat, and fixing means for fixing said device to the upper slats;

wherein the fixing means comprise a strip for being placed across and over said upper slats, said strip having a respective bend at each of its ends for co-operating with respective outer edges of said two upper slats, one of the bends being connected to the suspension device by a junction wall, and wherein the strip further comprises two lugs extending downwards from the sides of the strip for being received in the gap between the two upper slats.

13. A single piece tension-varying slider for a set of three slats in a bed base, the set comprising two parallel slats in the plane on which the mattress rests together with a lower slat disposed substantially in the vertical midplane between the two upper slats, said slats being supported at their ends by securing means engaging the longitudinally-extending members of the frame of the bed base, said slider comprising a suspension device for bearing against the lower slat, and fixing means for fixing said device to the upper slats;

wherein the fixing means comprise a strip for being placed across and over said upper slats, said strip having a respective bend at each of its ends for co-operating with respective outer edges of said two upper slats, one of the bends being connected to the suspension device by a junction wall, and wherein the strip carries a vertical peg on its bottom face for being received at least in part in an orifice formed in the top wall of the suspension device.

* * * * *